US007891587B2

(12) United States Patent
Mattes

(10) Patent No.: US 7,891,587 B2
(45) Date of Patent: Feb. 22, 2011

(54) INTERMEDIATE PLATE FOR A FUEL INJECTOR, AND FUEL INJECTOR

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 56 days.

(21) Appl. No.: 12/093,989

(22) PCT Filed: Oct. 9, 2006

(86) PCT No.: PCT/EP2006/067170

§ 371 (c)(1),
(2), (4) Date: May 16, 2008

(87) PCT Pub. No.: WO2007/057254

PCT Pub. Date: May 24, 2007

(65) Prior Publication Data

US 2008/0237373 A1 Oct. 2, 2008

(30) Foreign Application Priority Data

Nov. 21, 2005 (DE) ..... 10 2005 055 359

(51) Int. Cl.

| | |
|---|---|
| ***F02M 59/00*** | (2006.01) |
| ***F02M 39/00*** | (2006.01) |
| ***F02M 61/00*** | (2006.01) |
| ***B05B 1/30*** | (2006.01) |
| ***B05B 1/14*** | (2006.01) |

(52) U.S. Cl. ..... 239/590; 239/533.2; 239/533.3; 239/533.12; 239/575; 239/584; 239/585.1

(58) Field of Classification Search ..... 239/533.2, 239/533.3, 533.7, 533.12, 575, 584, 585.1, 239/585.3, 585.4, 585.5, 590
See application file for complete search history.

(56) References Cited

U.S. PATENT DOCUMENTS

| | | | | |
|---|---|---|---|---|
| 3,115,304 | A * | 12/1963 | Humphries | 239/90 |
| 4,566,416 | A * | 1/1986 | Berchtold | 123/458 |
| 4,684,067 | A * | 8/1987 | Cotter et al. | 239/533.3 |
| 5,287,838 | A * | 2/1994 | Wells | 123/467 |
| 5,577,667 | A * | 11/1996 | Ganser | 239/533.8 |
| 6,116,522 | A * | 9/2000 | Kampichler | 239/533.2 |
| 6,170,757 | B1 * | 1/2001 | Herrmann et al. | 239/88 |

(Continued)

FOREIGN PATENT DOCUMENTS

DE 201 10 130 U1 10/2002

(Continued)

*Primary Examiner*—Len Tran
*Assistant Examiner*—Ryan Reis
(74) *Attorney, Agent, or Firm*—Ronald E. Greigg

(57) ABSTRACT

The invention relates to an intermediate plate for a fuel injector, comprising a high-pressure through-hole which connects a high-pressure passage in a valve body and is connected to a high-pressure fuel reservoir, to a high-pressure space in a nozzle body, wherein the intermediate plate is arranged between the valve body and the nozzle body. In order to improve the injection behaviour of a fuel injector provided with the intermediate plate, in particular during multiple injection of small injection quantities, the high-pressure through-hole has a cross-sectional profile which improves the flow through the high-pressure through-hole from the valve body towards the nozzle body and impairs the flow in the opposite direction from the nozzle body towards the valve body.

10 Claims, 1 Drawing Sheet

U.S. PATENT DOCUMENTS

| | | | | |
|---|---|---|---|---|
| 6,871,803 | B1 * | 3/2005 | Ohmi et al. | 239/596 |
| 2004/0099250 | A1 | 5/2004 | Strahberger et al. | |

FOREIGN PATENT DOCUMENTS

| | | | |
|---|---|---|---|
| DE | 101 43 511 | A1 | 3/2003 |
| EP | 1 304 475 | A1 | 4/2003 |
| FR | 2 845 129 | A1 | 4/2004 |
| WO | WO 2004/005704 | | 1/2004 |

* cited by examiner

INTERMEDIATE PLATE FOR A FUEL INJECTOR, AND FUEL INJECTOR

CROSS-REFERENCE TO RELATED APPLICATION

This application is a 35 USC 371 application of PCT/EP 2006/067170filed on Oct. 9, 2006.

BACKGROUND OF THE INVENTION

Field of the Invention

The invention relates to an intermediate plate for a fuel injector and to a fuel injector embodying the intermediate plate.

SUMMARY AND ADVANTAGES OF THE INVENTION

The object of the invention is to improve the injection performance of a fuel injector that is equipped with an intermediate plate in particular in multiple injections of small injection quantities.

In an intermediate plate for a fuel injector, having a high-pressure through-hole, which connects a high-pressure passage, that is provided in a valve body and is in communication with a high-pressure chamber fuel reservoir, with a high-pressure chamber that is provided in a nozzle body, and the intermediate plate is disposed between the valve body and the nozzle body, this object is attained in that the high-pressure through-hole has a cross-sectional course by which the flow through the high-pressure through-hole from the valve body to the nozzle body is improved and in the opposite direction from the nozzle body to the valve body is worsened. Within the scope of the present invention, it has been discovered that one cause of instabilities in multiple injections is pressure fluctuations in the injector. Pressure fluctuations are caused on the one hand by the pressure drop during the injection and on the other by the pressure surge upon needle closure. The pressure fluctuations cause a change in the needle forces, which in turn lead to deviations in the injection quantity. In one essential aspect of the invention, the high-pressure through-hole does not have a constant cross section, but instead a cross-sectional course by which the unwanted pressure fluctuations are damped.

A preferred exemplary embodiment of the intermediate plate is characterized in that the high-pressure through-hole has a larger diameter on its end toward the valve body than on its end toward the nozzle body. The high-pressure through-hole in the intermediate plate, which is also called a valve plate, is used according to the invention as a damping element. The high-pressure through-hole is preferably a bore that is embodied such that propagation of the underpressure wave upon needle closure is prevented, and the replenishing flow is improved. As a result, direction-dependent flow coefficients are created by which the damping performance can be optimally adjusted.

A further preferred exemplary embodiment of the intermediate plate is characterized in that the high-pressure through-hole is embodied conically. By means of a defined conicity, the damping properties of the high-pressure through-hole can be adjusted in a targeted way. It is important to adapt the cone angle to the length of the high-pressure through-hole.

A further preferred exemplary embodiment of the intermediate plate is characterized in that the high-pressure through-hole has a cylindrical recess on its end toward the valve body.

By adapting the various diameters to the associated lengths, the damping properties of the high-pressure through-hole can be adjusted in a targeted way.

Further preferred exemplary embodiments of the intermediate plate are characterized in that the high-pressure through-hole has a chamfer or a radius on its end toward the valve body. As a result, the flow coefficient in the inflow direction is maximized.

A further preferred exemplary embodiment of the intermediate plate is characterized in that the high-pressure through-hole has a sharp edge on its end toward the nozzle body. As a result, the flow coefficient in the outflow direction is minimized.

A further preferred exemplary embodiment of the intermediate plate is characterized in that the intermediate plate is embodied in one piece. However, the intermediate plate can also be embodied in multiple parts and include multiple intermediate plate elements that have one common high-pressure through-hole.

In fuel injector, having a valve body that has a high-pressure passage which is in communication with a high-pressure chamber fuel reservoir, and having a nozzle body that has a high-pressure chamber, the aforementioned object is attained in that an intermediate plate as described above is disposed between the valve body and the nozzle body.

BRIEF DESCRIPTION OF THE DRAWINGS

Further advantages, characteristics and details of the invention will become apparent from the ensuing description, in which various exemplary embodiments are described in detail in conjunction with the drawings, in which.

Figure 3:
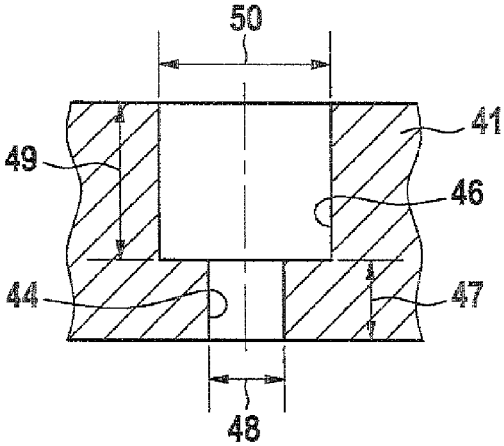
Figure 4:
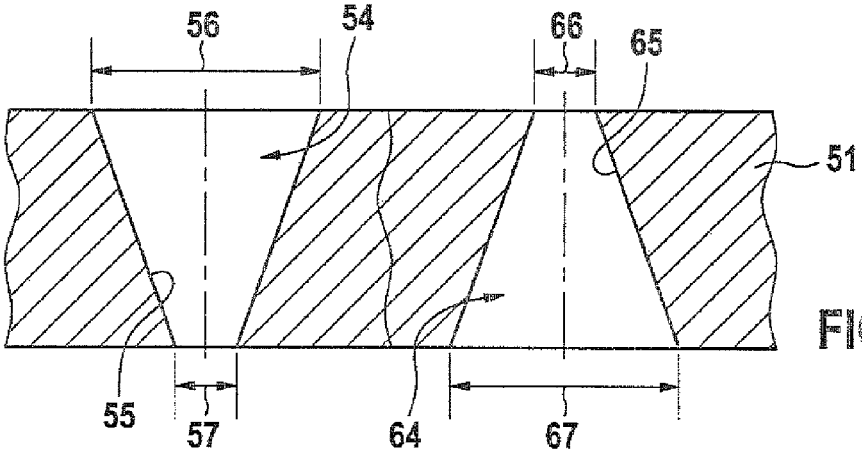

F*ig*. 2 is a fragmentary view through an injector in longitudinal section, with an intermediate plate in accordance with a first exemplary embodiment;

FIG. 3, an intermediate plate in accordance with a second exemplary embodiment in section; and FIG. 4, an intermediate plate in accordance with a third exemplary embodiment, in section.

DESCRIPTION OF THE PREFERRED EMBODIMENTS

Figure 1:
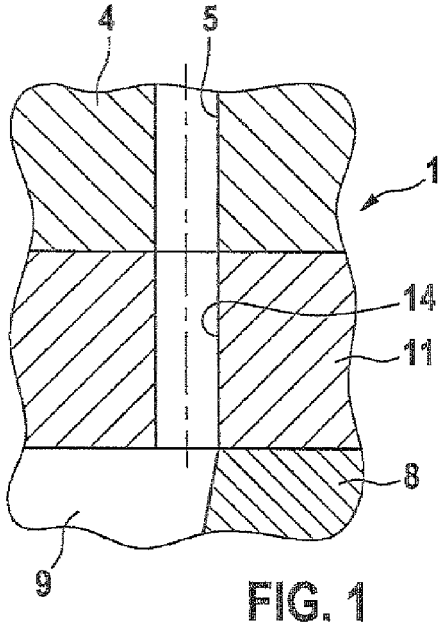
FIG. 1 ( PRIOR ART )
FIG. 1 is a fragmentary view of a conventional fuel injector in longitudinal section.

In FIG. 1, part of a fuel injection valve 1, also called a fuel injector, is shown in longitudinal section. The fuel injection valve 1 is used for installation in an internal combustion engine, not shown, of a motor vehicle and is embodied here as a common rail injector for injection preferably of diesel fuel. The fuel injection valve includes a nozzle module and a valve control module and is connected to an electronic control unit, also not shown here.

The valve control module includes a valve body 4 with a high-pressure passage 5. The high-pressure passage 5 is in communication with a high-pressure chamber fuel reservoir, not shown, and in operation of the engine is filled with fuel at a high pressure of up to 1.5 kg/bar. The nozzle module includes a nozzle needle, which is disposed and guided in a nozzle body 8 and which controls injection nozzles of the fuel injection valve 1 that lead to a combustion chamber of the engine. On the end remote from the injection nozzles, the nozzle needle includes a valve control piston, which is received, such that it can move back and forth, in an axial bore in the nozzle body 8.

A high-pressure chamber 9 is embodied in the nozzle body 8 and is partly defined by an intermediate pressure plate 11, which is fastened between the nozzle body 8 and the valve body 4. The intermediate pressure plate 11, which is also called a valve plate, includes a high-pressure through-hole 14, which connects the high-pressure passage 5 of the valve body 4 with the high-pressure chamber 9 of the nozzle body 8. In the prior art fuel injector 1 shown in FIG. 1, the high-pressure through-hole 14 is formed by a bore that has a constant diameter.

For attaining low emission values, it is necessary, with a fuel injector of the kind shown in part in FIG. 1, to employ small fuel quantities in a stable manner. Particularly the subdivision into a plurality of small injections in close succession is becoming increasingly important. One essential aspect of the present invention is to disclose structural possibilities for improving the quantity stability in the presence of short injection spacings.

One cause of instability in multiple injections is pressure fluctuations in the injector, which in turn are caused by a pressure drop during the injection on the one hand and by a pressure surge upon needle closure on the other. The associated pressure fluctuations cause a change in the needle forces, which in turn lead to deviations in the injection quantity. The pressure fluctuations can be damped by means of a skillful design of the flow conditions in the high-pressure circuit.

In one essential aspect of the invention, the high-pressure through-hole in the intermediate plate or valve plate is used as a damping element. The high-pressure through-hole is embodied in such a way that a propagation of the pressure wave upon needle closure is prevented, and the replenishing flow of fuel from the high-pressure passage through the high-pressure through-hole in the high-pressure chamber is improved. The damping performance can be adjusted by means of the associated direction-dependent flow coefficients.

Figure 2:
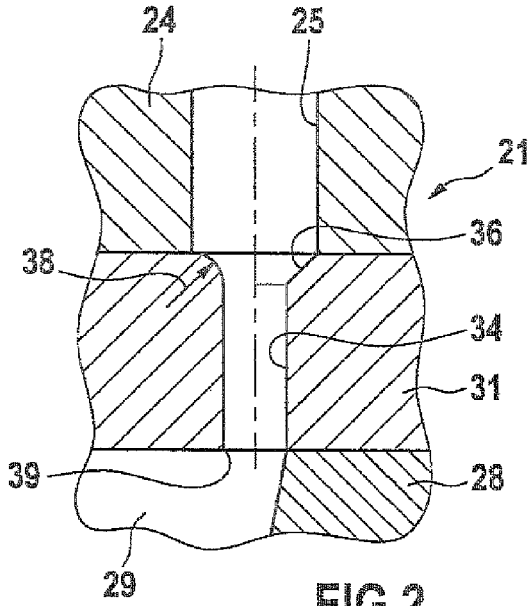

In FIG. 2, part of a fuel injector 21 is shown in longitudinal section; like the fuel injector 1 shown in FIG. 1, it has a valve body 24 with a high-pressure passage 25 and a nozzle body 28 with a high-pressure chamber 29. An intermediate plate 31 that has a high-pressure through-hole 34 is fastened between the valve body 24 and the nozzle body 28. The high-pressure through-hole 34, at the interface between the valve plate 31, also called an intermediate plate, and the valve body 24 has the same diameter as the high-pressure passage 25.

On the end of the high-pressure through-hole 34 toward the valve body 24, a chamfer 36 is embodied. Instead of the chamfer, the end toward the valve body 24 of the high-pressure through-hole 34 may also be rounded and provided with a radius 38. As a result of the chamfer 36 or the rounding with the radius 38, the flow coefficient in the inflow direction, that is, from the high-pressure passage 25 into the high-pressure chamber 29, is maximized. In the outflow direction, that is, from the high-pressure chamber 29 into the high-pressure passage 25, the flow coefficient is minimized by means of a sharp edge 39.

In FIG. 3, part of an intermediate plate 41 is shown in section. The intermediate plate 41 has a high-pressure through-hole 44, which is provided with a cylindrical counterbore or recess 46. Over a length 47, the high-pressure through-hole 44 has a relatively small inside diameter 48. The cylindrical recess 46, over a length 49, has a markedly greater inside diameter 50. The length 49 of the cylindrical recess 46 is likewise markedly greater than the length 47 of the high-pressure through-hole 44. By means of the cylindrical recess 46 and the lengths 47, 49 and the diameters 48, 50, the direction-dependent flow coefficients can be varied in a targeted way.

In FIG. 4, part of an intermediate plate 51 is shown in section. The intermediate plate 51 has a high-pressure through-hole 54, which is embodied as a cone 55. The cone 55, at the interface with the valve body, not shown, has a diameter 56 which is greater than a diameter 57 that is located at the interface with the nozzle body. Moreover, the intermediate plate 51 has a further through-hole 64, which likewise has the shape of a cone 65. However, the cone 65 tapers in the opposite direction from the cone 55. The cone 65 has a smaller diameter 66 at the interface with the valve body, and a greater diameter 67 at the interface with the nozzle body. By means of a suitable adaptation of the conicity to the length of the high-pressure through-holes, the damping properties can be adjusted in a targeted way.

The foregoing relates to a preferred exemplary embodiment of the invention, it being understood that other variants and embodiments thereof are possible within the spirit and scope of the invention, the latter being defined by the appended claims.

The invention claimed is:

1. In an intermediate plate for a fuel injector, having a high-pressure through-hole, which connects a high-pressure passage in a valve body and is in communication with a high-pressure chamber fuel reservoir, with a high-pressure chamber in a nozzle body, the intermediate plate being disposed between the valve body and the nozzle body, the improvement wherein:

the high-pressure through-hole having a cross-sectional course by which the flow through the high-pressure through-hole from the valve body to the nozzle body is improved and in the opposite direction from the nozzle body to the valve body is worsened, the high-pressure through-hole being conically shaped and tapering in a first direction, said intermediate plate including a further through-hole, said further through-hole being conically shaped and tapering in a second direction, said second direction being opposite said first direction, the intermediate plate having a first surface and a second surface and both the conically shaped high-pressure through-hole and the conically shaped further through-hole extending completely through the intermediate plate from the first surface to the second surface and, wherein each through-hole has a sloping conical surface which extends completely through the intermediate plate such that the sloping conical surface of each through-hole extends completely through the intermediate plate from the first surface to the second surface.

2. The intermediate plate as defined by claim 1, wherein the high-pressure through-hole has a larger diameter on its end toward the valve body than on its end toward the nozzle body.

3. The intermediate plate as defined by claim 1, wherein the intermediate plate is embodied in one piece.

4. The intermediate plate as defined by claim 2, wherein the further through-hole has a larger diameter on its end toward the nozzle body than on its end toward the valve body.

5. The intermediate plate as defined by claim 1, wherein the further through-hole has a larger diameter on its end toward the nozzle body than on its end toward the valve body.

6. In an intermediate plate for a fuel injector, having a high-pressure through-hole, which connects a high-pressure passage in a valve body and is in communication with a high-pressure chamber fuel reservoir, with a high-pressure chamber in a nozzle body, the intermediate plate being disposed between the valve body and the nozzle body, the improvement wherein:

the high-pressure through-hole having a cross-sectional course by which the flow through the high-pressure through-hole from the valve body to the nozzle body is improved and in the opposite direction from the nozzle body to the valve body is worsened, the high-pressure through-hole being conically shaped and tapering in a first direction, said intermediate plate including a further through-hole, said further through-hole being conically shaped and tapering in a second direction, said second direction being opposite said first direction, the intermediate plate having a first surface and a second surface and both the conically shaped high-pressure through-hole and the conically shaped further through-hole extend completely through the intermediate plate from the first surface to the second surface and, wherein the conical shape of each through-hole extends all of the way through the intermediate plate from the first surface to the second surface.

7. The intermediate plate as defined by claim 6, wherein the high-pressure through-hole has a larger diameter on its end toward the valve body than on its end toward the nozzle body.

8. The intermediate plate as defined by claim 6, wherein the intermediate plate is embodied in one piece.

9. The intermediate plate as defined by claim 7, wherein the further through-hole has a larger diameter on its end toward the nozzle body than on its end toward the valve body.

10. The intermediate plate as defined by claim 6, wherein the further through-hole has a larger diameter on its end toward the nozzle body than on its end toward the valve body.

* * * * *